United States Patent [19]

Leeyeh

[11] Patent Number: 5,016,154

[45] Date of Patent: May 14, 1991

[54] CONNECTION STRUCTURE FOR THE SUPPORTING ROD OF A FLOOR LAMP

[76] Inventor: Chuing-Hui Leeyeh, P.O. Box 96-405, Taipei 10098, Taiwan

[21] Appl. No.: 576,998

[22] Filed: Sep. 4, 1990

[51] Int. Cl.[5] ..... F21S 1/12

[52] U.S. Cl. ..... 362/414; 362/431

[58] Field of Search ..... 362/395, 410, 414, 431

[56] References Cited

U.S. PATENT DOCUMENTS

| | | | |
|---|---|---|---|
| 4,449,170 | 5/1984 | Warshawsky | 362/414 X |
| 4,562,520 | 12/1985 | Chapman | 362/414 |
| 4,797,798 | 1/1989 | Schumaker et al. | 362/414 X |

FOREIGN PATENT DOCUMENTS

| | | | |
|---|---|---|---|
| 1348566 | 12/1963 | France | 362/410 |

*Primary Examiner*—Ira S. Lazarus
*Assistant Examiner*—Peggy A. Neils

[57] ABSTRACT

An improved connection structure for the supporting rod of a floor lamp, which can easily be disassembled for packing, and assembled quickly to use; the top part of the rod has a rotary switch and a joint member; the upper part of the stub connector is provided with two recess points, and a L-shaped groove. A joint member is provided with two L-shaped connecting grooves and a slanting-and-curved side so as to facilitate the joint member to connect with the upper end of the stub connector. The joint member also has a round hole for receiving wire terminals; when the supporting rod is disassembled, the wires of the lamp can also be disassembled for packing convenience; therefore, the structure of the supporting rod can provide high safety for the wires.

3 Claims, 6 Drawing Sheets

CONNECTION STRUCTURE FOR THE SUPPORTING ROD OF A FLOOR LAMP

BACKGROUND OF THE INVENTION

1. Field of the Invention:

This invention relates to a connection structure for the supporting rod of a floor lamp, and particular to a floor lamp, of which the vertical supporting rod can be disassembled for packing and shipping convenience; further, the lamp is also provided with a means to maintain the power wires in a safety condition.

2. Brief Description of the Prior Arts:

In the current floor lamps, they generally comprise a bulb socket, a lamp base, and three sections of supporting rods as a result of the height limitation thereof to facilitate the manufacturing and packing. The top section of the supporting rods is usually mounted with a rotary switch to control the power supply. The power wires mounted on the rotary switch have only a given additional length without any fixedly fastening means. The opening of the rod section with a rotary switch is unable to find the connecting contacts for wire terminals according to the U.S. regulations for electric equipment; also, the connecting contacts can not be pulled out easily. Further, in the conventional floor lamps, two sections of supporting rods are usually connected together with threads, and the power wires pass through the round hollow portion of the supporting rods. A decorative ring with threads on both ends thereof is mounted under the rod section. By means of such structure, the power wires in the supporting rod with a rotary switch would not be damaged during packing steps of the lamp.

Since the supporting rods are connected each other by means of threads, the rod should have a given thickness; in that case, the cost of the lamp will be increased naturally. Moreover, the connecting portion of the supporting rods should have inner or outer threads, and therefore quality control would become another problem among the mid and lower processing factories; otherwise, the thread portions of the supporting rods would have difficulty to mate each other. If such quality control problem were discovered after the products being sold in overseas market, the problem would become more serious than ever.

In another conventional lamp of the kind, the power switch is installed on the lamp base or on the wires outside the lamp body. The power wires are directly connected to the bulb socket with a given length to facilitate the packing and disassembling operation. The power wires are tied into a knot before extending outside the lamp base, and then the wires are fastened in place to prevent from being pulled off un-intentionally; however, such method is deemed different from that of the present invention.

SUMMARY OF THE INVENTION

This invention provides an improved connection structure for the supporting rod of a floor lamp, in which the top part is mounted with a rotary switch; one end of the top part is detachably connected with a stub connector that includes a joint member. The stub connector and the joint member are connected together by means of a L-shaped groove and a recess point. After the joint member is connected with the top part, the power terminals in the top part can be used to connect power wires. The wires are tied into a knot to be retained in a wire retainer to prevent the wires from being pulled out un-intentionally; the wires attached to the rotary switch would not be pulled off. The top part and the lower part are connected together by means of the stub connector to be rotated at a given angle.

According to the present invention, a joint member is installed in the stub connector; both of them are connected together by means of the L-shaped grooves and the recess points by rotating at a given angle for quick and sure connection.

According to the present invention, the bottom of the joint member has a round hole, in which a wire retainer is mounted for retaining the wires by tying the wire into a knot so as to prevent the wires from being pulled off un-intentionally.

According to the present invention, the joint member has two L-shaped grooves to be engaged with two recess points on the stub connector upon being rotated at a given angle; further, the joint member also has a slanting-curved surface to facilitate the L-shaped grooves on the stub connector to move upon the lower part being rotated to connect with the stub connector.

According to the present invention, a stub connector is installed at the lower end of the top part, and the stub connector is to be connected with other related parts by means of the L-shaped grooves and the recess points thereof.

DESCRIPTION OF THE PREFERRED EMBODIMENT

Figure 1:
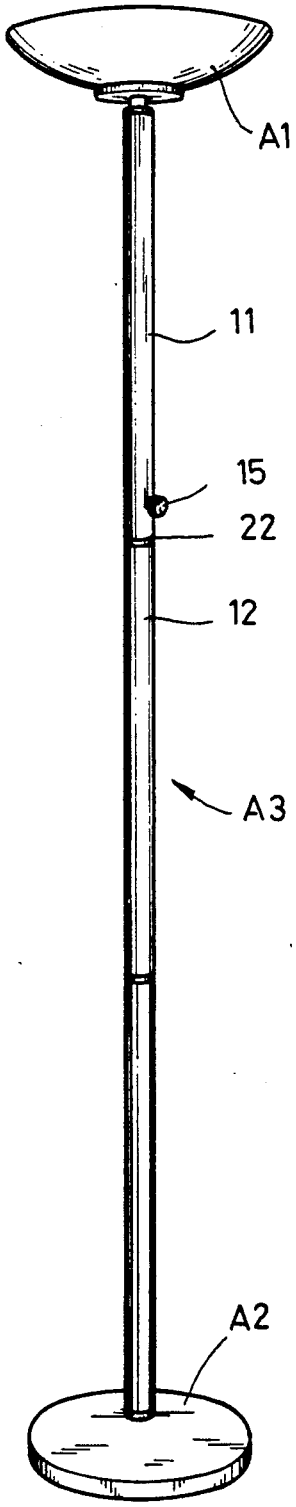
FIG. 1 is a perspective view of an embodiment according to the present invention.

This invention relates to an improved connection structure for the supporting rod of a floor lamp, as shown in FIG. 1, which mainly comprises a lamp base A2, a bulb socket A1, and a detachable pipe A3. For shipment convenience, the detachable pipe includes three sections of detachable pipes. There are power wires to pass through the detachable pipes and the lamp base A2. For shipment, the lamp can be disassembled and packed into a box. When the lamp is to be used, the detachable pipes can be assembled into one piece togehter with the lamp base A2 and the bulb socket A1; then, the wires tucked away in the pipes can also be pulled out.

Figure 2:
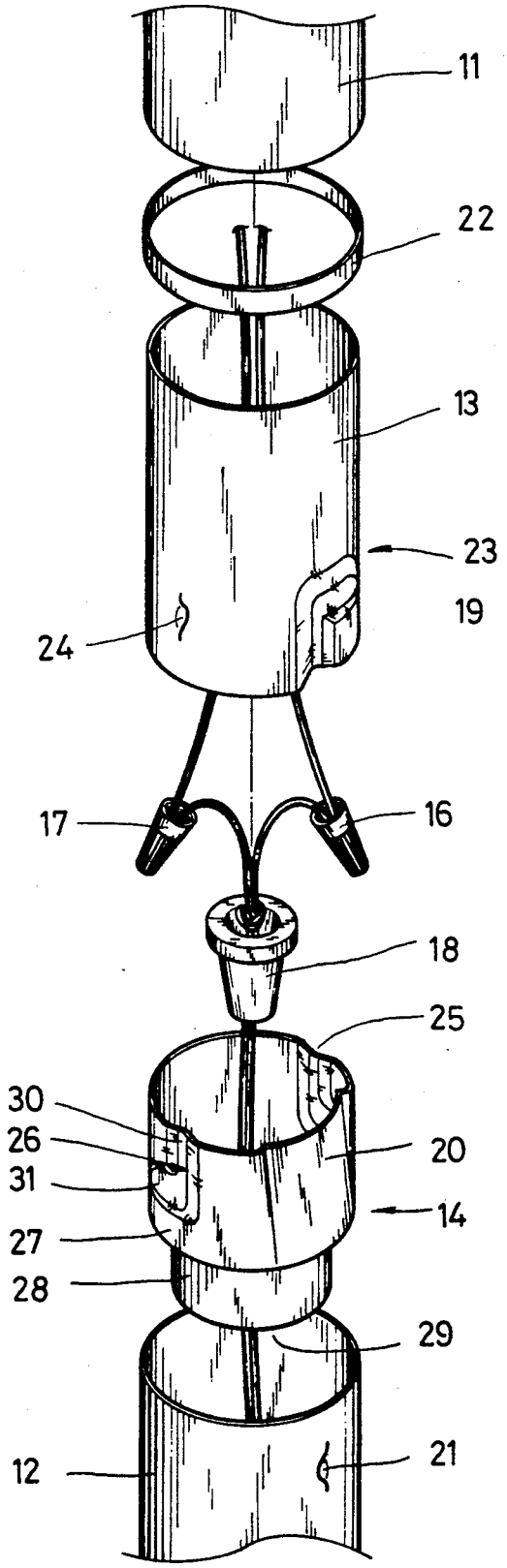
FIG. 2 is a disassembled view of the joint portion according to the present invention.

As shown in FIGS. 1 and 2, the present invention mainly comprises a lamp base A2, a bulb socket A1, and the detachable pipe A3. The detachable pipe A3 includes a top part 11, a lower part 12, and another section of pipe. A rotary switch 15 is mounted in the lower portion of the top part 11 for controlling the ON/OFF function of the power supply of the lamp. After the rotary switch 15 is mounted in the top part 11, a plurality of power terminals are furnished in the top part 11. As shown in FIGS. 2 to 11, there is a stub connector 13 mounted between the top part 11 and the lower part 12. Under the stub connector 13, there is a joint member 14, whereby the power wires can be mounted in the top part 11 securely. On the outer surface of the stub connector 13, there are two recess points 23 and 24, and a L-shaped groove 19. The recess points 23 and 24 are used for positioning and fixing the joint member 14 in place; the L-shaped groove 19 is used for connecting and fixing the lower part 12 in place.

The top part 11 and the stub connector 13 are made of metal; the stub connector 13 has a smaller diameter than that of the top part 11 so as to be fitted in the top part 11 fixedly by welding method, or by means of plastic steel. The lower portion of the stub connector 13 are furnished with two opposite recess points 23 and 24, and a L-shaped groove 19, whereby the connection with a joint member 14 and the lower part 12 is made.

Figure 3:
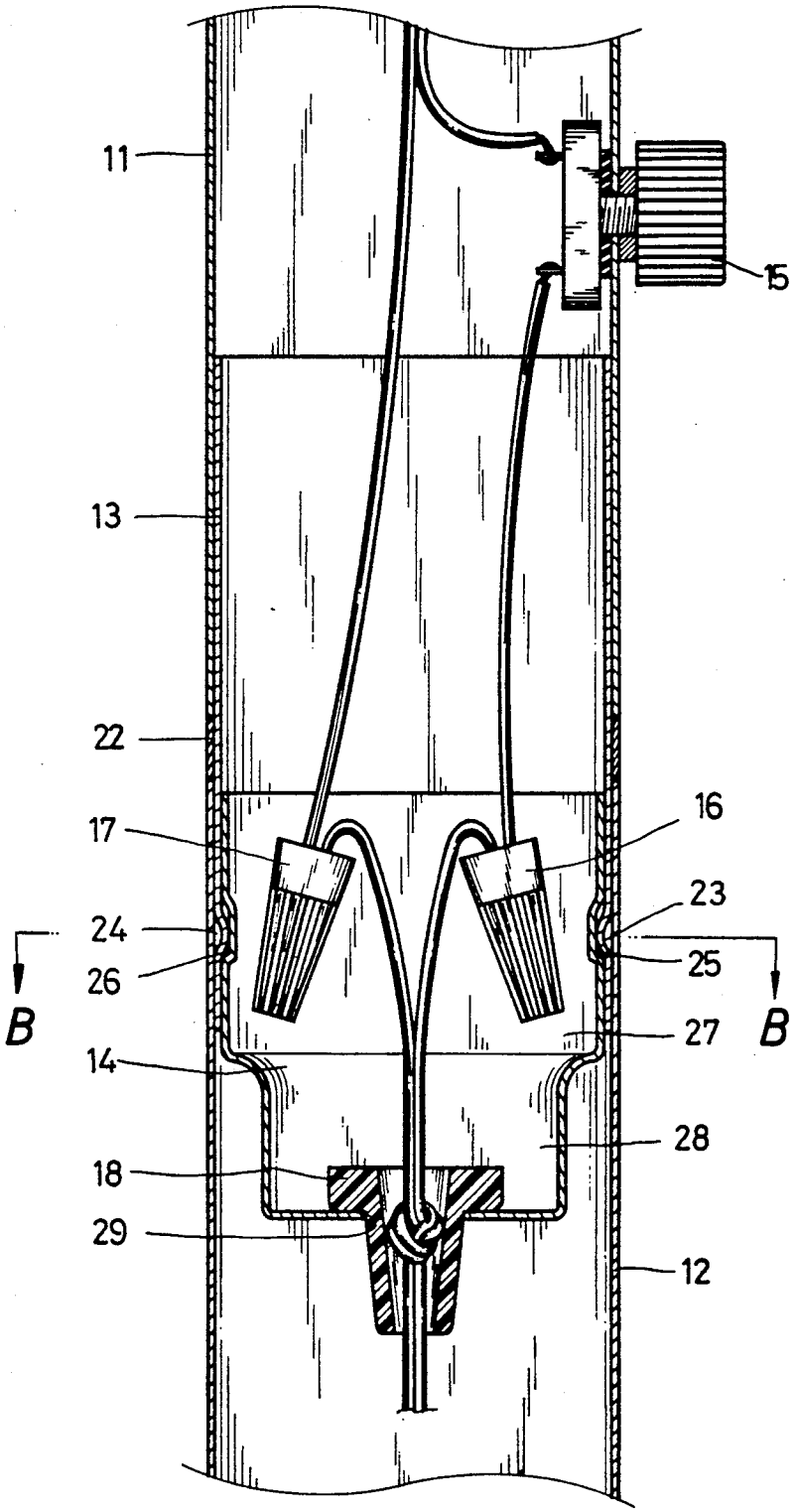
FIG. 3 is a fragmental sectional view of the joint ends of the present invention, showing a top part and a stub connector being closely connected together.
Figure 6:
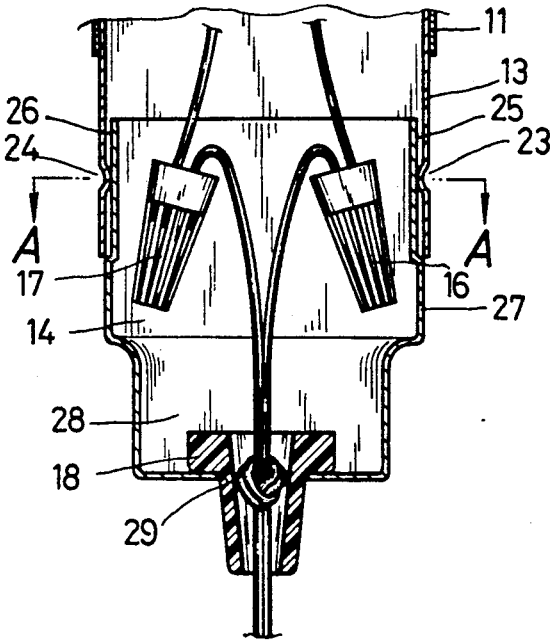
FIG. 6 is another fragmental sectional view of the joint portion between the top part and stub connector according to the present invention.
Figure 7:
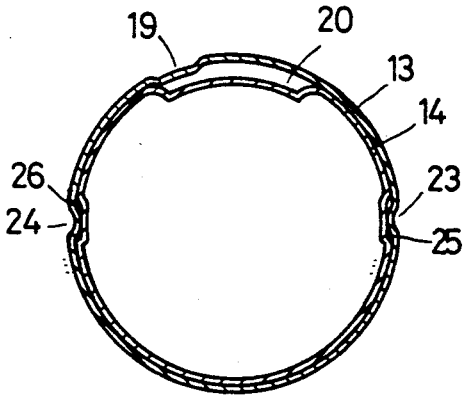
FIG. 7 is a sectional view taken along line A—A in FIG. 6.
Figure 8:
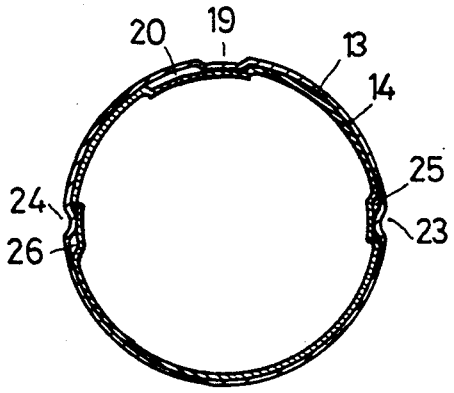
FIG. 8 is a sectional view taken along line B—B in FIG. 3.

The joint member 14 has an upper cylinder 27 to connect with the stub connector 13; the lower portion of the joint member 14 has a lower cylinder 28 having a smaller diameter than that of the upper cylinder 27. The bottom of the lower cylinder 28 has a round hole 29. The joint member 14 is to be mounted in the stub connector 13 to provide the power wire terminals with a chamber to prevent from un-intentional pulling. The outer surface of the upper cylinder 27 has two L-shaped grooves 25 and 26, and a slanting-curved surface 20, whereby the joint member 14 can be mounted in and connected with the stub connector 13. The L-shaped grooves 25 and 26 on the joint member 14 are made by punching into such shape. The L-shaped grooves 25 and 26 are used to engage with the recess points 23 and 24 on the stub connector 13 respectively for guide-and-connection purpose as shown in FIGS. 6 and 7. After the joint member 14 is inserted into the stub connector 13 at a given depth, the joint member 14 will be rotated at an angle so as to have the recess points moved into the horizontal grooves 31 respectively as shown in FIGS. 3 and 8.

Figure 4:
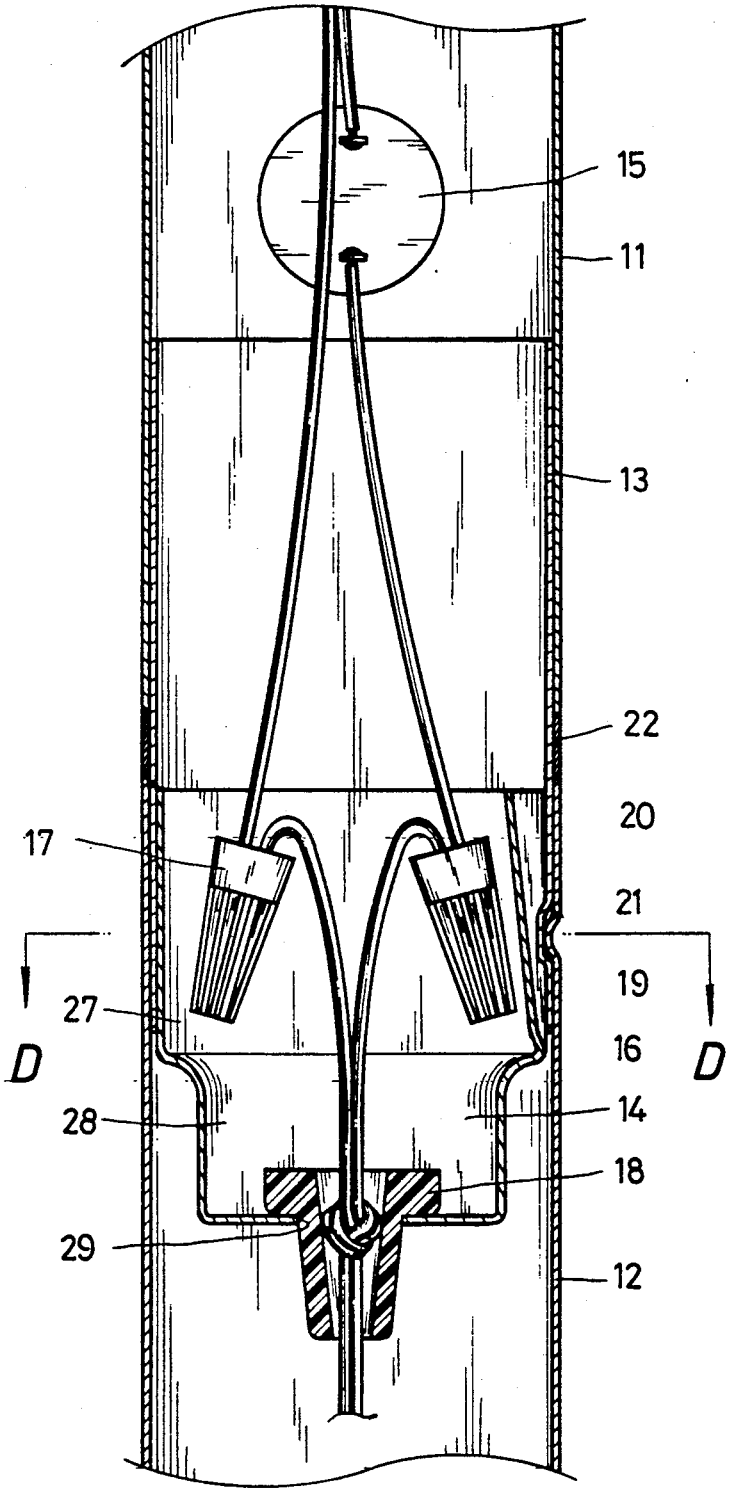
FIG. 4 is a fragmental sectional view of the joint portion according to the present invention, showing a lower part and the stub connector being closely connected together.
Figure 5:
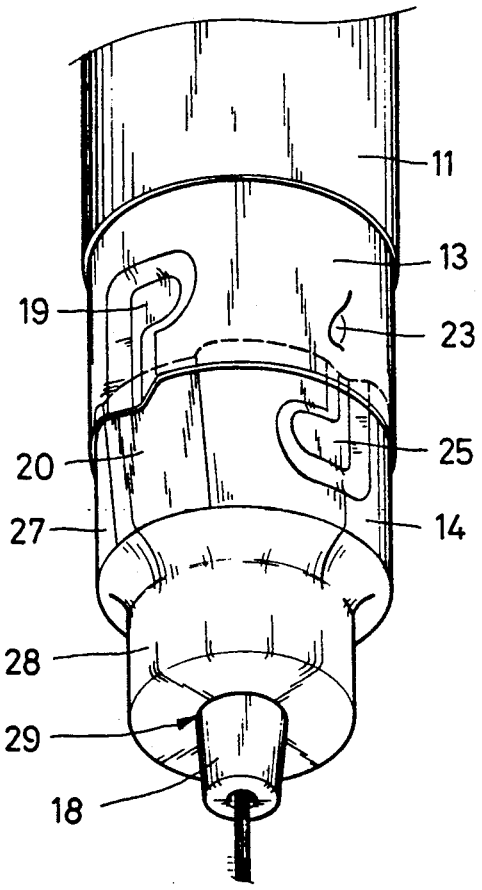
FIG. 5 is a fragmental perspective view of the joint portion between the top part and the stub connector according to the present invention.
Figure 10:
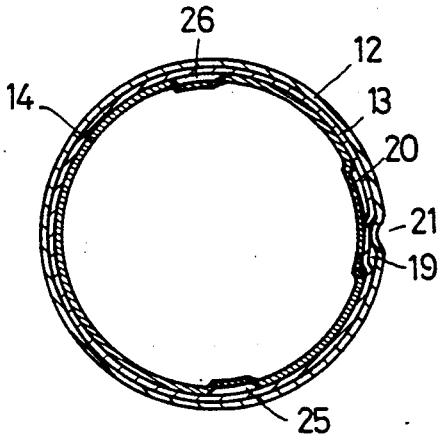
FIG. 10 is a sectional view taken along line C—C in FIG. 9.
Figure 9:
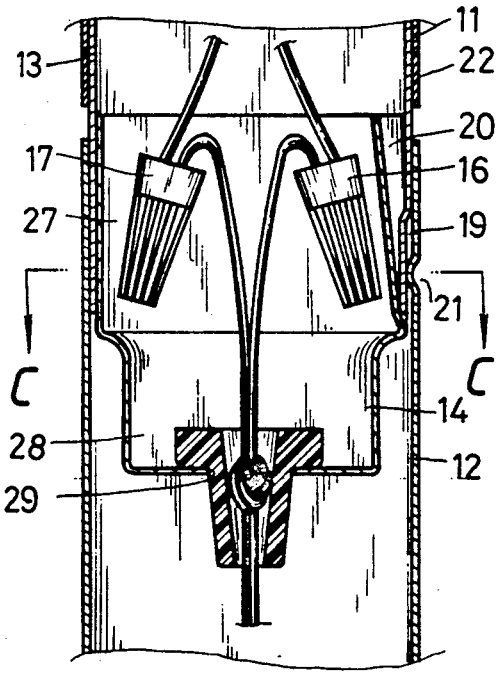
FIG. 9 is another fragmental sectional view of the joint portion between the lower part and the stub connector according to the present invention.
Figure 11:
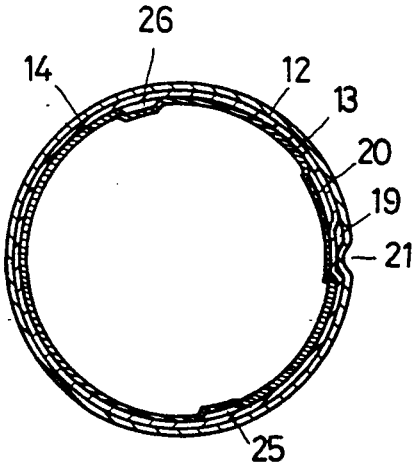
FIG. 11 is a sectional view taken along line D—D in FIG. 4.

Since the stub connector 13 is to be connected with the joint member 14 and the lower part 12, one side of the stub connector 13 has a L-shaped groove 19, which is used for connecting with the lower part 12. In order to prevent from hindering difficulty between the L-shaped groove 19 and the opening of the joint member 14 to engage with the stub connector 13, one side of the upper cylinder 27 of the joint member 14 is provided with a slanting-curved surface 20, of which the length is slightly longer than the vertical portion of the L-shaped groove. Upon the joint member 14 and the stub connector 13 being connected together as shown in FIGS. 9 and 10, the joint member 14 is to be rotated after the L-shaped grooves 25 and 26 are set in place. As shown in FIGS. 4 and 11, the position of the slanting-curved surface 20 has been designed to provide a space to let the L-shaped groove 19 rotate freely at an angle, i.e., the width and angle of the slanting-curved surface 20 would not affect the function of the L-shaped groove 19 on the stub connector 13 during connection.

Before the joint member 14 being connected with the stub connector 13, the power wires should be laid from the plug through the supporting rod, the round hole 29 of the joint member 14, and the wire retainer 18 in which the wires are tied into a knot; the wires are then connected electrically with the wires in the upper parts by means of two wire terminals 16 and 17 respectively. The bottom of the joint member 14 has a round hole 29, in which a wire retainer 18 is mounted. The wire retainer 18 has a cone-shaped through hole for retaining the wire knot therein. The wire retainer is used for making the wires ready to connect or disconnect upon the lamp being packed up or unpacked for use. After the power wires pass through the round hole 29, the wires are held in place with a wire retainer to prevent the wires from being damaged by un-intentional pulling.

After the joint member 14 and the stub connector 13 are connected together, a L-shaped groove 19 on the stub connector 13 will be engaged with a recess point 21 on the lower part 12 so as to provide a fixed connection between the lower part 12 and the stub connector 13. Before the top part 11 and the lower part 12 being connected together, a decorative ring 22 is mounted around the lower portion of the stub connector 13 for decoration and buffer function.

As shown in FIGS. 4, 9 ans 11, the assembling function of the present invention is to be done by means of two L-shaped grooves 25 and 26, and a slanting-curved surface 20 on the upper cylinder 27 of the joint member 14, which are to be mated by relative rotation with two recess points 23 and 24, and a L-shaped groove 19 on the stub connector 13 respectively. The bottom of the lower cylinder 28 of the joint member 14 has a round hole 29 for mounting a wire retainer 18 therein. The wire retainer 18 can facilitate a rotary switch 15 being installed on the top part 11 as power wire contacts; further, the wire retainer can also prevent the wires connected with the rotary switch from being pulled off un-intentionally.

Briefly, the improved connection structure for the supporting rod of a floor lamp mainly comprises a stub connector on the top part, and a joint member, whereby the supporting rods of the lamp can be connected with each other, the power wires can be connected electrically securely without being pulled off un-intentionally.

I claim:

1. An improved connection structure for a supporting rod of a floor lamp comprising a lamp base, a bulb socket and a plurality of supporting rods; and a rotary switch being mounted on one of said supporting rods; said supporting rods mainly including:

a top part being connected together with a stub connector;

said stub connector having one end connected with said top part and an opposite end thereof being provided with recess points and a L-shaped groove;

a joint member including an upper cylinder and a lower cylinder; and said upper cylinder having a plurality of symmetrical L-shaped grooves and a slanting-curved surface; and said lower cylinder having a bottom with a round hole, in which a wire retainer is mounted, and power wires pass through;

said wire retainer retaining a wire knot therein;

a lower part having a recess point to be engaged with said L-shaped groove on said stub connector; and wherein said joint member is connected by rotation with said stub connector in a lower end of said top part.

2. An improved connection structure for a supporting rod of a floor lamp as claimed in claim 1, wherein said top part and said stub connector are connected together by means of spot welding if they are made of metal.

3. An improved connection structure for a supporting rod of a floor lamp as claimed in claim 1, wherein said top part and said stub connector are molded directly as one piece if they are made of plastic steel material.

* * * * *